United States Patent [19]

Silverstolpe et al.

[11] 4,026,547

[45] May 31, 1977

[54] BELT WITH ADJUSTABLE BACK SUPPORT PLATE

[76] Inventors: Marianne Silverstolpe, Nora Strand 3, 182 34 Danderyd; Lennart Silverstolpe, Skytteholmsvagen 26, 171 44 Solna, both of Sweden

[22] Filed: Aug. 12, 1975

[21] Appl. No.: 603,817

[30] Foreign Application Priority Data

Aug. 19, 1974 Sweden ..... 7410543

[52] U.S. Cl. ..... 272/109; 2/44; 2/305

[51] Int. Cl.[2] ..... A63B 7/02

[58] Field of Search ..... 272/60 R; 2/44, 45, 2/305, 311; 119/96; 244/143; 128/78; 182/3; 9/336, 329; 114/9, 20–24

[56] References Cited

UNITED STATES PATENTS

| | | | |
|---|---|---|---|
| 1,983,829 | 12/1934 | Ziminski | 128/78 |
| 3,424,134 | 1/1969 | Rosenblum | 119/96 |
| 3,598,114 | 8/1971 | Lewis | 128/78 |
| 3,769,938 | 11/1973 | Hudziak et al. | 119/96 |
| 3,888,245 | 6/1975 | Berntson et al. | 128/78 |

*Primary Examiner*—Richard C. Pinkham
*Assistant Examiner*—William R. Browne
*Attorney, Agent, or Firm*—Strauch, Nolan, Neale, Nies & Kurz

[57] ABSTRACT

A back belt for use by sailors particularly in racing to provide support when a sailor is inclined out from a side of the ship to counterbalance the inclination of the boat, the belt having portions to extend around crotch, waist, back and over the shoulders of the wearer, a front located hook device and an arrangement for an adjustable back support plate. The belt has a back portion that extends substantially the length of the back of a user and receives a supporting plate therein. The supporting plate is connected at its upper most end by adjustable straps that extend over the shoulders of a user and connect to a hook device in the front of a user. The bottom most portion of the supporting plate connects to an adjustable fork strap that extends under the crotch of a user and connects to a hook device on the front of a user. The supporting plate may be adjustably positioned relative to the back portion.

10 Claims, 3 Drawing Figures

BELT WITH ADJUSTABLE BACK SUPPORT PLATE

BACKGROUND OF THE INVENTION

The present invention relates to a back belt to be used by a sailor when sailing, especially when sailing in races. It is intended to replace the trapeze belts hitherto known for this purpose.

The known trapeze belts are placed around the fork or crotch and waist of a sailor or hand of a sailing boat. The trapeze belt of this kind has a trapeze hook located at the fork or crotch of the hand and connected to the mast of the sailing boat at a distance from the lower end of the mast. When the hand is standing generally horizontally out from the boat with his feet on the rail in order to counteract the inclination of the boat, his whole body weight substantially is resting in the trapeze belt. However, due to their constructions, these known trapeze belts cause pains in the back and other inconveniences, especially when the sailing goes on for a longer time than in a conventional race. Furthermore the low point of attachment causes pain in the fork. All this together decreases the effectiveness of the hand, which is disadvantageous, especially in races.

It is an object of the present invention to remove the disadvantages in the form of back and fork pains described above.

The present invention relates to a back belt to be used by sailors when sailing, said belt extending around the fork or crotch and waist of the sailor and having a trapeze hook at the front for attachment to a trapeze line, characterized by the fact, that it is provided with a back portion long enough to extend over a substantial part of the back of a sailor, preferably from the fork and up to the shoulder blades, and a supporting plate arranged in said back portion, preferably in a pocket or the like in said back portion, said supporting plate being longitudinally adjustable in said back portion. Furthermore, the upper part of said supporting plate is preferably connected to the trapeze hook by straps extending over the shoulders of the sailor, and the lower part of said supporting plate is preferably connected to the trapeze hook by a fork strap having a adjustable length.

The invention is illustrated by an embodiment shown in the attached drawings as an example.

Figure 1:
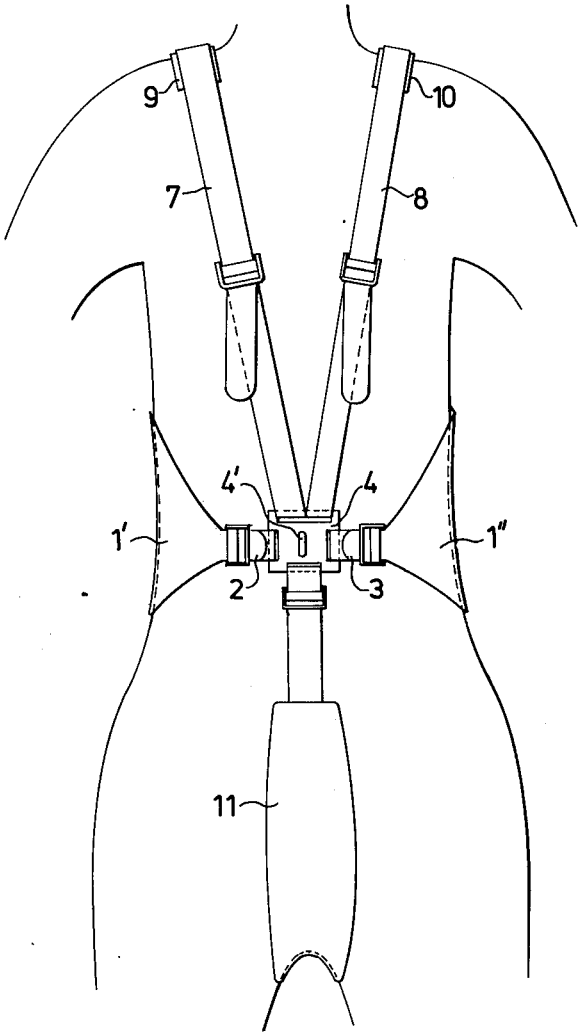
FIG. 1 is a front view of the back belt according to the invention when used by a person.
Figure 2:
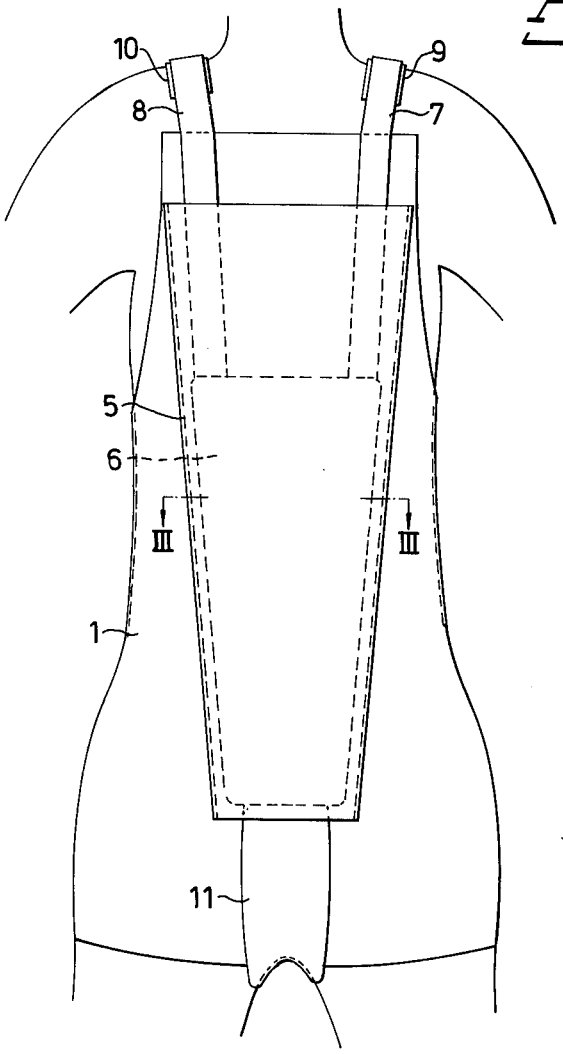
FIG. 2 is a back view of the back belt used by a person as in FIG. 1.
Figure 3:
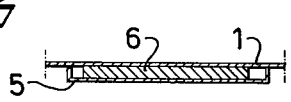
FIG. 3 shows a cross section at the line 111—111 in FIG. 2.

The back belt according to the invention comprises a back portion 1 of strong fabric and extending from the shoulder blades of a person down to the fork. It also comprises two flap-like front portions 1′ and 1″ located at the front waist portion of the person. The front portions 1′, 1″ are connected to a so called trapeze hook 4 by adjustable straps 2 and 3. Said trapeze hook is formed by a circular or rectangular plate having openings for attaching straps. At the centre of the front side of the plate there is a hook 4′ for removable attachment to a trapeze line, said trapeze line having a point of attachment at a distance from the lower end of the mast of a sailing boat. The trapeze hook 4 will be located about at the navel area of the person.

The back portion 1 is provided with a pocket or sleeve 5 extending in the longitudinal direction of the back portion, that is substantially from the upper to the lower part of the back portion. A supporting plate 6 is displaceably inserted in the pocket 5, said supporting plate being made of a steady and somewhat elastic material. Two adjustable straps 7 and 8, preferably of fabric, are arranged to extend between the upper part of said supporting plate 6 and said trapeze hook, said straps being long enough to extend over the shoulders of the person. At the shoulders the straps 7,8 are provided with soft pads 9,10. Alternatively the straps are padded or coated with a soft material along suitable parts or the whole of their lengths in order not to hurt the person's shoulders. A fork strap 11 is arranged to extend between the lower part of the supporting plate 6 and the trapeze hook 4, said fork strap having a adjustable length near the trapeze hook. The fork strap is furthermore wide as a diaper except for near the trapeze hook, and padded or coated with a soft material at its inner side in order not to hurt the groins of the person.

When worn by a sailor or hand the back portion 1 and the front portions 1′, 1″ are strapped to the body by the straps 2,3 the straps 7,8, the supporting plate 6 and the fork strap 11. As can bee seen in the figures, the trapeze hook 4 is located at about the centre of the stomach of the hand and the supporting plate 6 is supporting his whole back. By adjusting the length of the strap 7,8 relative to the length of the fork strap 11 the supporting plate 6 can be displaced in the pocket 5 to the desired location. When the trapeze hook 4,4′ is attached to a trapeze line, the hand, standing on the rail of the boat, can let substantially his whole body weight rest in the back belt, his back being effectively supported by the supporting plate.

The back belt according to the invention has the following advantages. It has a back supporting belt which is adjustable for different backs in order to give a good support. This will eliminate back pains. Furthermore, by the location of the trapeze hook 4, which is higher than in the devices previously known, the point of balance will be located higher, whereby the tension from all the straps including the fork strap will be more even in the back belt. This is very advantageous for the back, as it will not be as strained as when using a conventional belt. At the same time the strain on the groins will be less and the pressure will be more evenly distributed. All this leads to that the hand will be less tired and have considerably more staying power.

The invention is not restricted to only the embodiment described and illustrated in the drawings, as it can be modified within the scope of the invention. For example the straps extending over the shoulders and the fork strap can be fastened to the back portion instead of the supporting plate, said supporting plate being free in the pocket. The inner surface of the supporting plate can be formed as a back instead of being plane. The shapes of the back portion and the front portions can be varied. The vertical extension of the back portion, the pocket and the supporting plate can be varied. The supporting plate may for example be broader at its lower part than at its upper part, and it may also be less broad at the middle. The pocket may be formed by stripes or the like extending across the supporting plate. One or several of the straps attached to the trapeze plate 4 can be easily removably connected to the plate 6 by a hook or the like.

What we claim is:

1. A back belt to be used by sailors when sailing, said belt adapted to extend around the fork or crotch, shoulders and waist of the sailor and having: a trapeze hook device at the front for attachement to a trapeze line; a supporting plate; a back portion with means thereon to locate said supporting plate on the back portion, said back portion being long enough to extend over a substantial part of the back of a sailor from adjacent the fork and up to adjacent the shoulder blades, and having two lateral side portions attached thereto at intermediate locations; said side portions being adapted to wrap around the waist of the sailor and each side portion having connection means releasably connected to said trapeze hook device; and adjustable means connecting between the supporting plate and the trapeze hook device including means for passing over the shoulders and means for passing under the fork of the sailor to enable independent adjustment of the vertical location of the supporting plate on the back of the sailor.

2. A back belt according to claim 1, wherein said back portion includes a pocket means thereon and said supporting plate is located in said pocket means.

3. A back belt according to claim 1, wherein said means for passing over the shoulders and said means for passing under the fork each include means enabling adjustment of length of the connection means to permit said vertical adjustment of the location of the support plate on the back of the sailor.

4. A back belt according to claim 1, wherein both of said means for passing over the shoulders and said means for passing under the fork are directly connected to said supporting plate.

5. A back belt according to claim 1, characterized by the fact, that the means for passing under the fork is a fork strap having a substantial width and provided with a soft coating at its inner side in order not to hurt the groins of the sailor.

6. A back belt to be used by sailors when sailing, said belt adapted to extend around the fork or crotch, waist and shoulders of the sailor and having: a trapeze hook device at the front for attachment to a trapeze line, a back portion long enough to extend over a substantial part of the back of the sailor from adjacent the fork and up to adjacent the shoulder blades; and supporting plate; means in the back portion engaging and locating the supporting plate relative to the back portion; upper straps adapted to extend over the shoulders and connecting the upper part of said supporting plate to the trapeze hook device; and a fork strap adapted to pass under the fork of the sailor and connecting the lower part of the supporting plate to the trapeze hook device, the length of said fork strap between said trapeze hook and said supporting plate being adjustable.

7. A back belt according to claim 6, characterized by the fact, that the trapeze hook device is located at the navel area of the sailor when the belt is in use because the foremost part of the fork strap connected to the trapeze hook device has a substantial length from its lowest portion at the fork and to the trapeze hook device.

8. A back belt according to claim 6, characterized by the fact, that the fork strap has a substantial width and is provided with a soft coating at its inner side in order not to hurt the groins of the sailor.

9. A back belt according to claim 6 wherein said back portion includes a pocket means thereon with openings at top and bottom; said supporting plate is located in said pocket means, and said upper straps and said fork strap pass through the respective top and bottom openings of said pocket means.

10. A back belt according to claim 6 wherein said upper straps and said fork strap each include means enabling adjustment of strap length to permit vertical adjustment of the location of the support plate on the back of the sailor.

* * * * *